US009682274B1

(12) United States Patent
Ekstrom

(10) Patent No.: US 9,682,274 B1
(45) Date of Patent: Jun. 20, 2017

(54) MULTIPURPOSE WEIGHTLIFTING AND TRAINING LOG DEVICE

(71) Applicant: Cade Ekstrom, Jacksonville, FL (US)

(72) Inventor: Cade Ekstrom, Jacksonville, FL (US)

( * ) Notice: Subject to any disclaimer, the term of this patent is extended or adjusted under 35 U.S.C. 154(b) by 33 days.

(21) Appl. No.: 14/822,981

(22) Filed: Aug. 11, 2015

(51) Int. Cl.

| | |
|---|---|
| ***A63B 21/00*** | (2006.01) |
| ***A63B 21/075*** | (2006.01) |
| ***A63B 21/06*** | (2006.01) |
| ***A63B 23/12*** | (2006.01) |

(52) U.S. Cl.
CPC ..... *A63B 21/075* (2013.01); *A63B 21/0602* (2013.01); *A63B 21/0603* (2013.01); *A63B 21/1469* (2013.01); *A63B 23/12* (2013.01)

(58) Field of Classification Search
CPC ..... A63B 21/00
USPC ..... 482/106, 107, 108, 109, 110
See application file for complete search history.

(56) References Cited

U.S. PATENT DOCUMENTS

| | | | |
|---|---|---|---|
| 7,244,220 | B2 | 7/2007 | Carney |
| 7,758,477 | B2 | 7/2010 | Prenatt |
| 8,727,951 | B2 | 5/2014 | Jones et al. |
| 2012/0088639 | A1 | 4/2012 | Dalcourt |

*Primary Examiner* — Jerome W Donnelly
(74) *Attorney, Agent, or Firm* — Lawrence J. Gibney; Mitchell R Ghaneie

(57) ABSTRACT

A piece of exercise equipment that combines multiple functions will allow the user to perform multiple exercises with one device as opposed to multiple devices. It will also incorporate the ability to add water or sand to the device that will allow the user to exercise multiple areas of the body with one piece of equipment as opposed to multiple pieces of equipment and avoids the user from purchasing multiple pieces of exercise equipment.

8 Claims, 7 Drawing Sheets

MULTIPURPOSE WEIGHTLIFTING AND TRAINING LOG DEVICE

BACKGROUND OF THE INVENTION

A. Field of the Invention

This invention pertains to safely training and lifting a weight in the shape of a log, while also allowing a user to store other workout gear and perform various other weight-lifting exercises. The device is also capable of being filled with sand or water.

B. Prior Art

U.S. Pat. No. 8,727,951 by Jones et al. (Jones), U.S. Pat. No. 7,758,477 by Prenatt, U.S. Pat. No. 7,244,220 by Carney, and US patent application publication by Dalcourt all disclose a tubular weight training device. Each of these patents and patent application publication teach a cylindrical training device for the Olympic Log used in weight lifting competitions. Carney discloses the idea of placing a standard barbell through the interior of a cylindrical exercise device. Carney offers three separate holding positions: one by holding the barbell and the second and third by holding integrated handles. There are a set of handles that are closer together and a set of handles that are further apart. The handles are positioned perpendicular to the barbell.

Dalcourt discloses various tubular devices. Some have cutouts in the cylindrical drum to provide a user with a place to grip. Other variations include handles that are integrated in the drum. Dalcourt also teaches a device that can be dragged by a user with a rope.

Although Carney and Dalcourt do not teach or anticipate filling the cylinder with water or sand, Jones and Prenatt do. Jones discloses the handles and wells below the handles. Prenatt discloses a handle on the end of the log. Also, both Jones and Prenatt each teach multiple holding positions for lifting the device.

The aspects that distinguish this invention from the above referenced patents and patent application publication are the adjustable sleeves attached to the square feet that slide over the shaft attached to the cylindrical drum, the fact that the sleeves aid in securing additional weight to the drum, the square feet themselves, which prevent the device from rolling as well as offer the user options to perform additional exercises, and a storage compartment for safely keeping extra workout equipment and gear. This invention also offers a handle on each sleeve that may be used for bent over rows.

An alternate embodiment allows for a plastic insert or liner to be placed inside the drum for holding water or sand. The plastic insert would also provide wells that will prevent the user's arm from potentially falling into the drum while it is in use.

BRIEF SUMMARY OF THE INVENTION

This invention is a multipurpose weightlifting and training device. It is intended to train individuals for lifting an Olympic log and other exercises, which are used in various weightlifting competitions. There are two contemplated embodiments of this invention.

The first embodiment is comprised of a closed metal cylindrical drum with three separate handles and may be filled with sand or water. Behind each of the three handles will be a built in metal well that is part of the cylindrical drum structure.

Two shafts extend outward from opposite ends of the metal cylinder and are intended to hold weights. An adjustable sleeve is provided to slide over the shaft and is capped with square feet coated in rubber. The sleeve is utilized to secure weights that may be placed on the shaft of the device. The square feet attached to the sleeve will have a plurality of predetermined sized cutouts for a user to grab the feet's outer rim. The feet will be large enough to help prevent the device from rolling on a surface.

On one side of the cylinder will be two handles running parallel to each other. On the opposite side of the cylinder will be the third handle and it is placed perpendicularly to the other two handles. The third handle spans the length of the cylindrical drum and can be called a "farmer's handle". In the event that the user's hand slips from a handle while pushing the device over one's head the wells will prevent the user's hand and arm from falling into the device. The wells also serve to seal the device for potentially holding water or sand. Recessed ports will be provided in order to pour water or sand in and out of the device.

A compartment with a compartment lid is also provided. The compartment will run parallel to the previously mentioned farmer's handle. The compartment can be used to store additional workout equipment and a harness for the device.

A removable harness may be provided so that the user may carry the device from location to location.

The second embodiment provides only changes to the cylindrical drum. The shafts, adjustable sleeves, feet, and feet cutouts will all operate similarly to how they were described in the first embodiment. In this second embodiment a plastic insert or liner that can be placed inside the metal cylindrical drum will be provided. The plastic insert will provide durable plastic wells for safety, recessed plastic ports, and a compartment. The cylindrical drum will still provide the cover over the compartment provided by the insert. The second embodiment will also provide an accurate means for determining how much water or sand is in the liner.

NUMBERING REFERENCE

5—Device

10—Closed Cylindrical Drum

Figure 1:
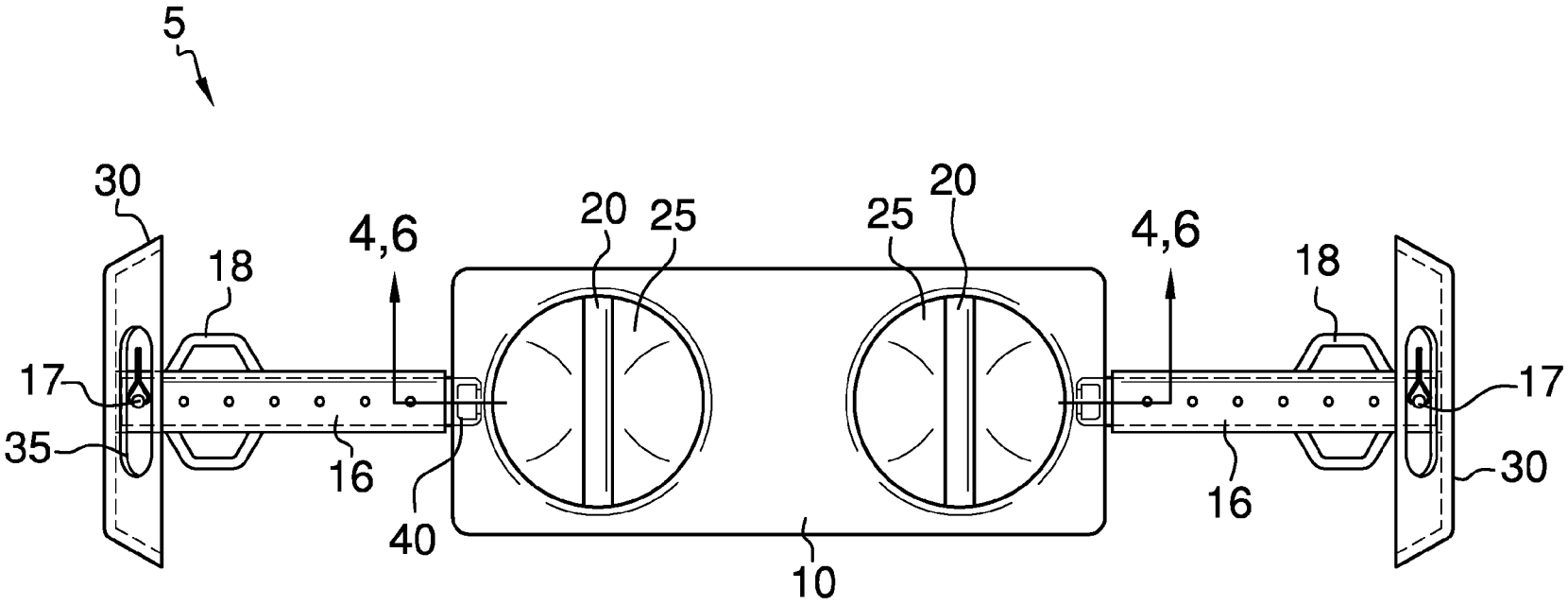
FIG. 1 is top view of the device.

15—Shaft
16—Adjustable Sleeve
17—Pin
18—Sleeve Handles
20—Lifting Handles
21—Farmer's Handle
25—Integrated Drum Wells
30—Feet
35—Feet cut-out
40—Recessed Drum Port
45—Drum Compartment
50—Drum Cavity
60—Open Cylindrical Drum
65—Liner
70—Well
75—Recessed Port for Plastic Liner
80—Compartment

DETAILED DESCRIPTION OF THE EMBODIMENTS

The device 5 is a multipurpose weightlifting and training device. It may be used as a training device for lifting the Olympic log, tire flipping, and various other exercises judged in competitions. The Olympic logs and tires used during competitions are relatively heavy for the average person. This device is intended to help a man or woman who desires to compete in such competitions to train by lifting the device in various ways. Once lifting the device becomes less strenuous the user has the option of adding weight. This invention provides two separate embodiments.

In both embodiments a harness (not depicted) could be provided so that the device can be easily carried from location to location.

First Embodiment

This first embodiment is comprised of a closed hollow cylindrical drum 10, a pair of lifting handles 20, a farmer's handle 21, shafts 15, adjustable sleeves 16, a locking means such as pins 17 to hold the adjustable sleeves in place, a pair of sleeve handles 18, integrated protective drum wells 25, feet 30, cut-outs in the feet 35, a drum compartment 45 with a lid, recessed ports 40, and a drum cavity 50 that may hold liquid or sand.

The cylindrical drum 10 provides three handles. One side of the cylindrical drum provides a first and a second lifting handle 20. The first and second lifting handles are parallel to each other in close proximity to each other and would typically be used simultaneously when lifting the log. While they are described as being parallel they may have other various orientations. The opposite side of the drum 10 provides a farmer's handle 21. The farmer's handle 21 spans the length of the drum 10 and can be independently used to lift the device 5.

Beneath each handle is an integrated drum well 25. The drum wells 25 serve a dual purpose. They each provide a degree of protection to the user when lifting the device because they each prevent a hand, wrist, or arm from falling into the drum 10 while in use. In addition, the drum wells 25 also allow the drum 10 to be completely enclosed so that it is water tight, thereby providing a closed inner drum cavity 50 within the drum 10. This in turn allows the drum 10 to hold water or sand.

The drum 10 additionally provides a drum compartment 45 with a hinged cover that spans the length of the drum and accessible by the user. The drum compartment 45 is intended to hold a harness 55 for carrying the device as well as other workout equipment, such as but not limited to, resistance bands, gloves, work out apparel, and chalk for grip.

The recessed ports 40, located on the ends of the drum 10, are provided to pour water or sand into the drum cavity 50. By having the water or sand in the cavity 50 the user will have to control the sloshing of the water or movement of the sand when lifting the device 5. Consequently, the woman or man lifting the device 5 can potentially have a more challenging workout.

Extending away from each end of the cylindrical drum 10 are shafts 15, that are secured to the cylindrical drum 10. The shafts 15 have predrilled holes that are set a predetermined distance away from each other. Each shaft 15 is capable of holding relatively large amounts of weight.

Figure 2:
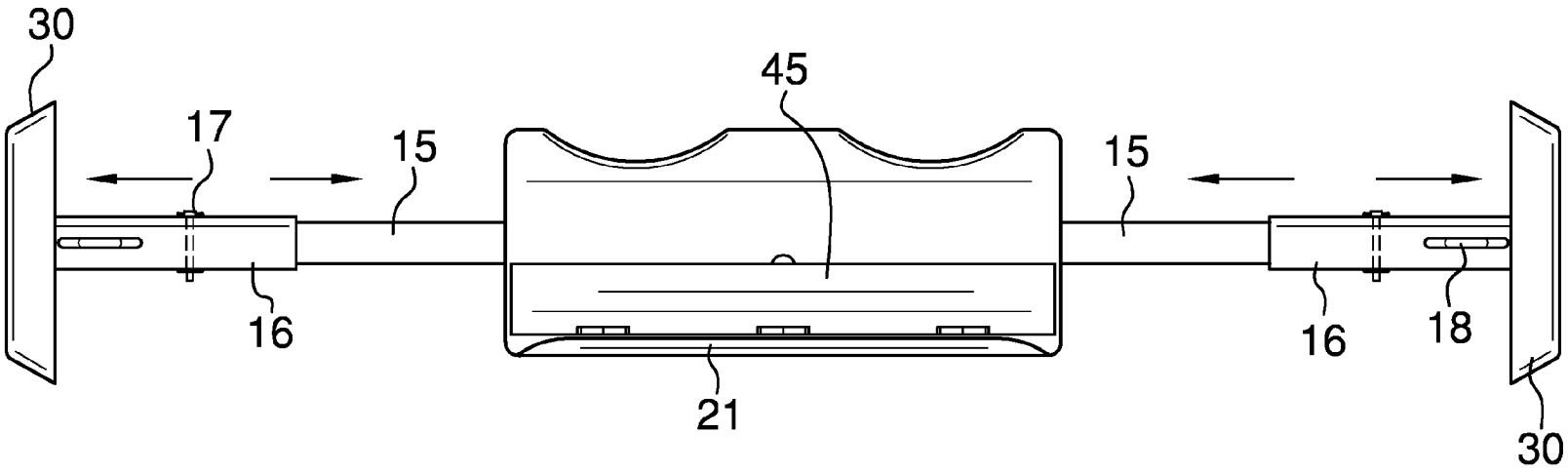
FIG. 2 is a side view of the device depicting the sleeves being adjustable.
Figure 3:
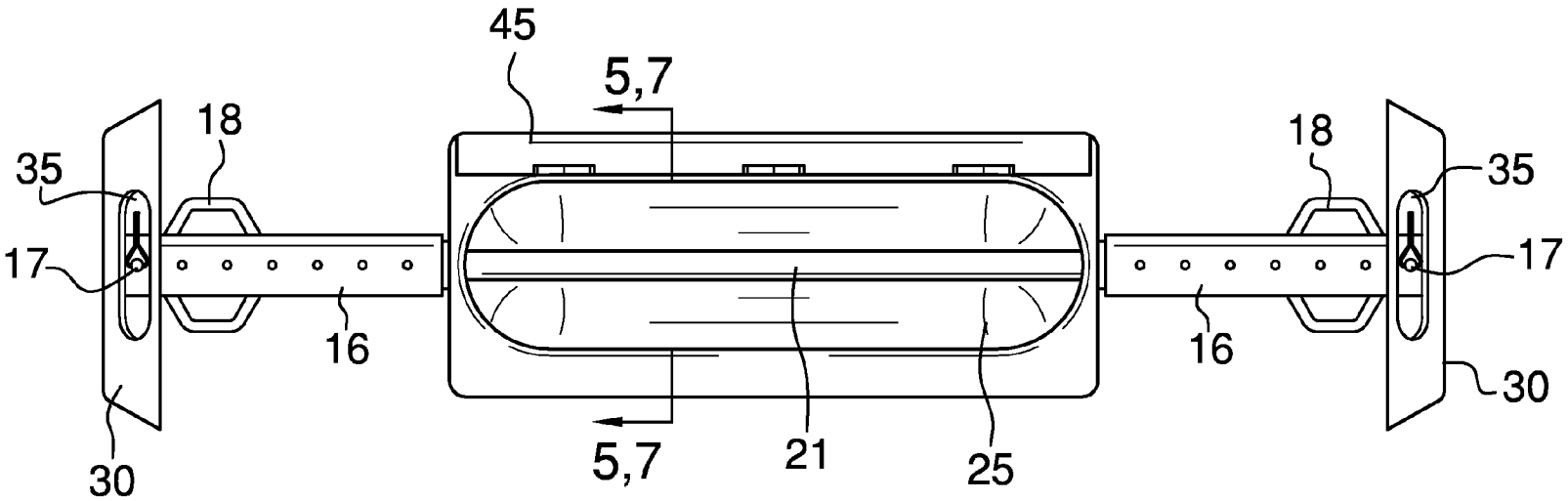
FIG. 3 is a bottom view of the device.
Figure 4:
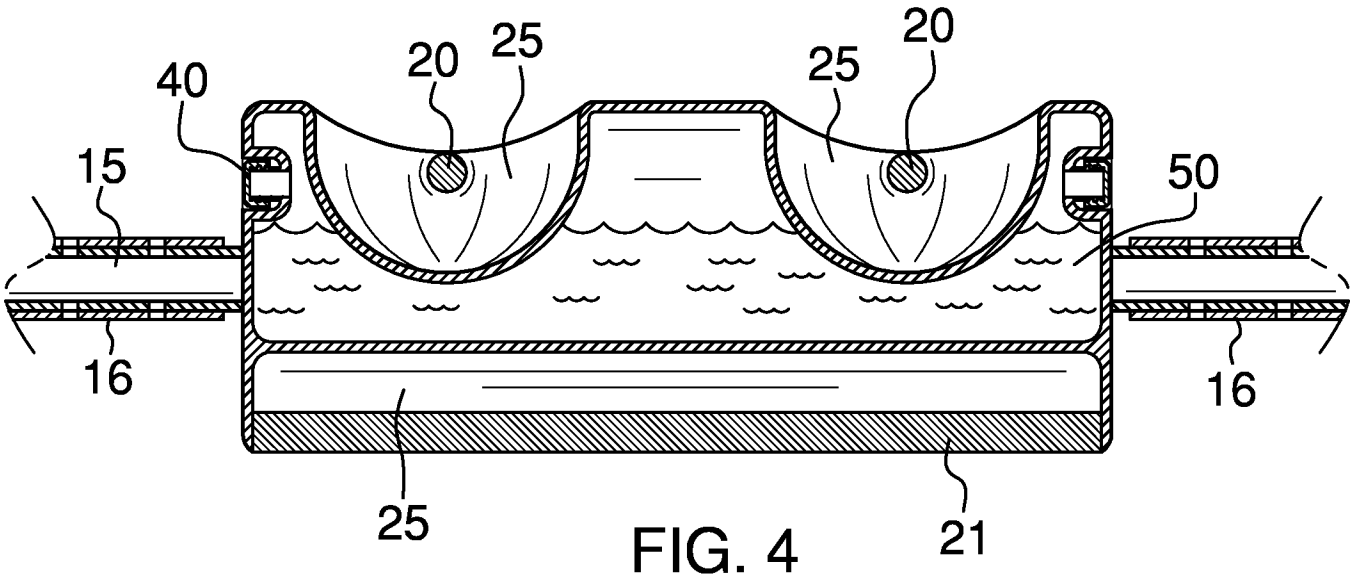
FIG. 4 is a cross-sectional view of a first embodiment depicting the closed cylindrical drum holding water, recessed ports, the integrated drum wells, the lifting handles, the farmer's handle, the shafts extending from the closed drum, and the sleeves over the shafts.
Figure 5:
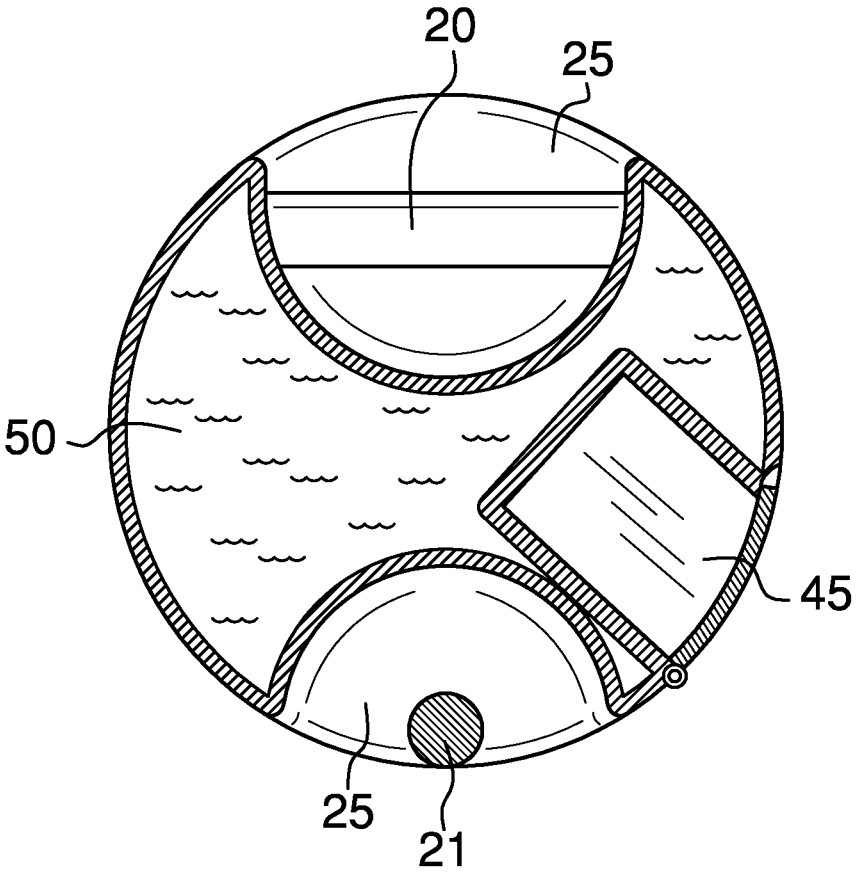
FIG. 5 is a cross-sectional view of the first embodiment depicting the closed cylindrical drum holding water, two of the integrated drum wells, one of the lifting handles, the farmer's handle, the drum compartment, and the lid covering the compartment.
Figure 6:
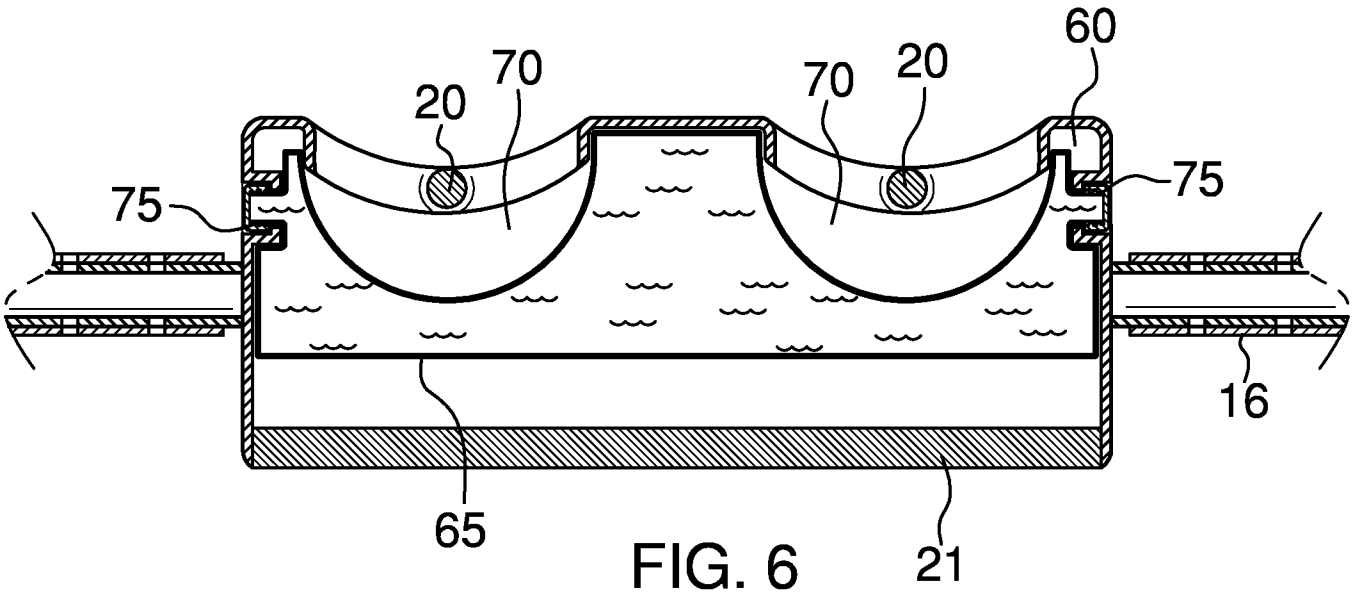
FIG. 6 is a cross-sectional view of a second embodiment depicting the open cylindrical drum, the plastic liner holding water, the recessed plastic liner ports, the wells, the lifting handles, the farmer's handle, the shafts extending from the open drum, and the sleeves over the shafts.
Figure 7:
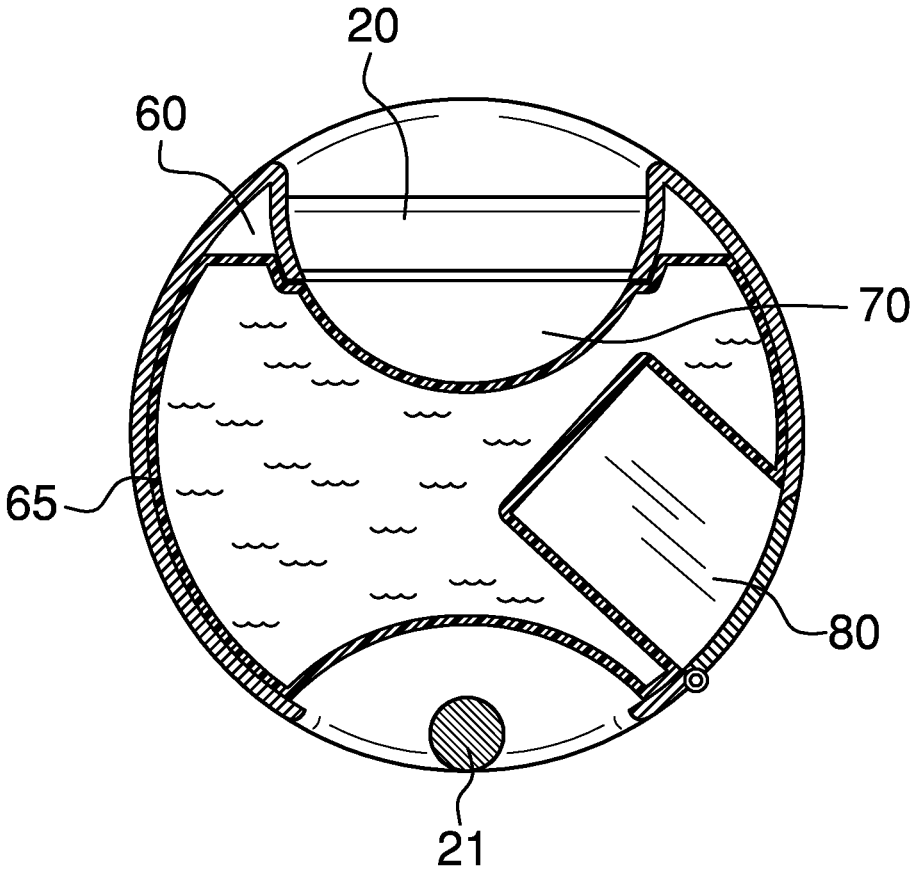
FIG. 7 is a cross-sectional view of the second embodiment depicting the open cylindrical drum, the plastic liner holding water, the two of the wells, one of the lifting handles, the farmer's handle, the plastic liner compartment, and the lid covering the compartment.

In order to accommodate significant amounts of weight, an adjustable sleeve with holes 16 will be placed over each shaft 15 as shown in FIGS. 1, 2, and 3. The sleeve 16 will provide two ends. The first end will be close to or up against the end of the cylindrical drum 10 or weights and the second end will be connected to a foot 30. A pair of sleeve handles 18 that may be utilized for bent over rows is also provided. One sleeve handle is provided on each of the sleeves 16. The sleeves 16 can slide to and from various positions along the shafts 15. Once the sleeve is placed in a desirable position it can be locked or held in placed by placing a pin 17 through the holes in the shaft 15 and sleeve 16.

The feet 30 located at the ends of the sleeves 16 have multiple cut-outs 35 as shown in FIG. 1 and FIG. 3. The cut-outs can be used to flip the device 5 end over end. The objective of using the cut-outs is to make the flipping motion similar to that of flipping a large tire. Alternatively, the feet 30 could provide handles (not depicted) instead of cut-outs.

Second Embodiment

In this second embodiment an open cylindrical drum 60 is provided with handles 20 and 21, similar to the first embodiment. Within the open drum 60 is a closed plastic liner 65. Although for the purposes of this description the liner is described as being plastic, other materials can potentially be used. The liner 65 is comprised of a plurality of wells 70, a plurality of plastic recessed jug ports 75, and a compartment 80. The drum 60 will provide a hinged lockable lid for covering the compartment 80, which may be used to store exercise equipment.

In the second embodiment the integrated wells 25 from the first embodiment have been removed and the liner 65 provides a well 70. The liner well 70 will protect the user's arm from injury by preventing a person's arm from completely entering into the cavity of the drum, similar to the function of the well 25 in the first embodiment.

The liner 65 is also capable of holding water or sand. One specific advantage of the liner is the ability to measure with great accuracy the weight of the water or sand that has been added to the device. Another advantage is the savings in manufacturing costs.

While the embodiments of the invention have been disclosed, certain modifications may be made by those skilled in the art to modify the invention without departing from the spirit of the invention.

The inventor claims:

1. A multipurpose weightlifting and training log device, which is comprised of:

a. a closed drum;

wherein the drum has a certain predetermined shape;

wherein the drum is cylindrical;

wherein the drum is hollow;
wherein the drum is watertight;
wherein the drum has a first end and a second end;
b. a pair of lifting handles;
wherein the pair of handles are provided on one side of the closed drum;
c. a farmer's handle;
wherein the farmer's handle is placed on the opposite side of the drum from the pair of lifting handles;
d. a pair of shafts;
wherein there is a first shaft and a second shaft;
wherein the first shaft is secured to the first end of said drum;
wherein the second shaft is secured to the second end of said drum;
e. a pair of sleeves;
wherein a first sleeve and a second sleeve is provided;
wherein the first sleeve covers the first shaft;
wherein the second sleeve covers the second shaft;
wherein the first sleeve slides over the first shaft;
wherein the second sleeve slides of the second shaft;
wherein the first sleeve provides a plurality of through holes;
wherein the second sleeve provides a plurality of through holes;
f. a pair of sleeve handles;
wherein there is a first sleeve handle and a second sleeve handle;
wherein the first sleeve handle is secured to the first sleeve;
wherein the second sleeve handle is secured to the second sleeve;
g. a locking means;
wherein a locking means is provided to secure the position of the sleeve over the shaft;
h. a pair of feet;
wherein a first foot and a second foot is provided;
wherein the first foot is affixed to the first sleeve;
wherein the second foot is affixed to the second sleeve;
i. an integrated drum well;
wherein the integrated drum well forms a portion of the structure of the cylindrical drum;
j. a drum compartment;
wherein the drum compartment has a lid;
wherein said lids allows access to the contents of the drum compartment;
k. a plurality of integrated ports;
wherein the plurality of integrated ports provide openings for water or sand to be poured into the drum cavity.

2. The device as described in claim 1 wherein handles are provided on the first foot and the second foot.

3. The device as described in claim 1 wherein cut-outs are provided on the first foot and the second foot.

4. The device as described in claim 1 wherein the plurality of integrated ports are recessed and do not protrude beyond the exterior surface of the closed drum.

5. A multipurpose weightlifting and training log device, which is comprised of:
a. An open drum;
wherein the open drum has a predetermined shape;
wherein the open drum is cylindrical;
wherein the open drum is hollow;
wherein the open drum has a first end and a second end;
wherein a lid is provided;
wherein a first opening and a second opening is provided;
wherein the first opening is in the first end;
wherein the second opening is in the second end;
b. a pair of lifting handles;
wherein the pair of handles are provided on one side of the open drum;
c. a farmer's handle;
wherein the farmer's handle is provided on the opposite side of the open drum from the pair of lifting handles;
d. a pair of shafts;
wherein a first shaft and a second shaft is provided;
where the first shaft is secured to the first end of the open drum;
wherein the second shaft is secured to the second end of the open drum;
e. a pair of sleeves;
wherein a first sleeve and a second sleeve is provided;
wherein the first sleeve covers the first shaft;
wherein the second sleeve covers the second shaft;
wherein the first sleeve slides over the first shaft;
wherein the second sleeve slides over the second shaft;
f. a pair of sleeve handles;
wherein a first sleeve handle and a second sleeve handle is provided;
wherein the first sleeve handle is secured to the first sleeve;
wherein the second sleeve handle is secured to the second sleeve;
g. a lock;
wherein a lock is provided to secure the position of the sleeve over the shaft;
h. a pair of feet;
wherein a first foot and a second is provided;
wherein the first foot is attached to the first sleeve;
wherein the second foot is attached to the second sleeve;
i. a liner;
wherein a liner is provided in the open drum;
wherein the liner is rigid;
wherein the provides wells below both lifting handles and the farmer's handle;
wherein the liner can store a predetermined amount of water;
wherein the liner can store a predetermined amount of sand;
wherein the liner provides a first end and a second end;
wherein the liner provides at least one integrated compartment;
wherein said integrated compartment is covered by the lid provided by the drum;
j. a plurality of ports;
wherein the plurality of ports are integrated in said liner;
wherein at least one port is provided on the first end of said liner;
wherein at least one port is provided on the second end of said liner;
wherein the ports allow for water to be poured into and out of the liner;
wherein the ports allow for sand to be poured into and out of the liner.

6. The device as described in claim 5 wherein cutouts are provided on the feet.

7. The device as described in claim 5 wherein a handle is provided on the feet.

8. The device as described in claim 5 wherein the plurality of ports are recessed and do not protrude beyond the exterior surface of the open drum.

* * * * *